United States Patent [19]

Morris et al.

[11] 3,993,309

[45] Nov. 23, 1976

[54] GAME APPARATUS UTILIZING A DISPLAY SCREEN

[75] Inventors: Howard E. Morris, Arlington Heights; Jeffrey D. Breslow, Highland Park; Eugene Jaworski, Park Ridge, all of Ill.

[73] Assignee: Marvin Glass & Associates, Chicago, Ill.

[22] Filed: Mar. 4, 1974

[21] Appl. No.: 447,779

[52] U.S. Cl. ..... 273/85 R

[51] Int. Cl.[2] ..... A63F 9/14

[58] Field of Search ..... 273/85 R, 88, 101.2, 273/DIG. 28, 1 E, 105.1, 101.1; 353/46, 47, 50, 51, 121; 352/38, 39

[56] References Cited

UNITED STATES PATENTS

| | | | |
|---|---|---|---|
| 2,467,180 | 4/1949 | Anderson | 273/101.2 |
| 2,593,117 | 4/1952 | Davenport | 273/105.1 |
| 2,644,884 | 7/1953 | Sullivan | 273/105.1 X |
| 2,665,133 | 1/1954 | Garrido | 273/105.1 |
| 2,957,695 | 10/1960 | De Valle Arizpe | 273/105.1 |
| 3,147,664 | 9/1964 | Gelfand | 273/105.1 X |
| 3,215,033 | 11/1965 | Van Gelder et al. | 353/51 |
| 3,326,552 | 6/1967 | Bilbao | 273/1 E |
| 3,337,287 | 8/1967 | Lessman | 353/51 X |
| 3,469,905 | 9/1969 | Baldwin et al. | 352/39 |
| 3,583,538 | 6/1971 | Hurley | 273/85 R X |
| 3,588,237 | 6/1971 | Aldrich | 273/105.1 X |
| 3,778,058 | 12/1973 | Rausch | 273/85 R |
| 3,838,525 | 10/1974 | Harvey | 353/51 |

*Primary Examiner*—Paul E. Shapiro
*Assistant Examiner*—Harry G. Strappello
*Attorney, Agent, or Firm*—Coffee and Sweeney

[57] ABSTRACT

An electrically and mechanically operated competitive amusement game, simulating the game of table tennis. The game includes a display screen so arranged that a game can be simulated thereon where two players appear to hit a ball, in the form of a light image, back and forth on the screen. The game includes a serve button for initiating a serve at the beginning of the game. The players continue to "volley" the simulated ball back and forth by timely actuation of two "volleying" buttons until a miss is detected. When a miss is detected, the ball comes to rest and a new serve is initiated to start the process again.

26 Claims, 8 Drawing Figures

156
150
206
128
116
130
162
164
160
166
112
114
110
144
72
78
76
74
152
124
134
140
142
94
96
138
122
136
126
154
18
100
184
180
86
324
322
316
312
A
380
378
376
314
306
304
308
302
372
374
370
298
36
366
34
296
382
362
364
368
92
90
292
300
294
290
288
360
70
358
82
84

38
270
272

284
282
14
274
276
280
30
286
288
290
292
294
296
298
300
302
304
306
308
310
312
316
322
A
34
36

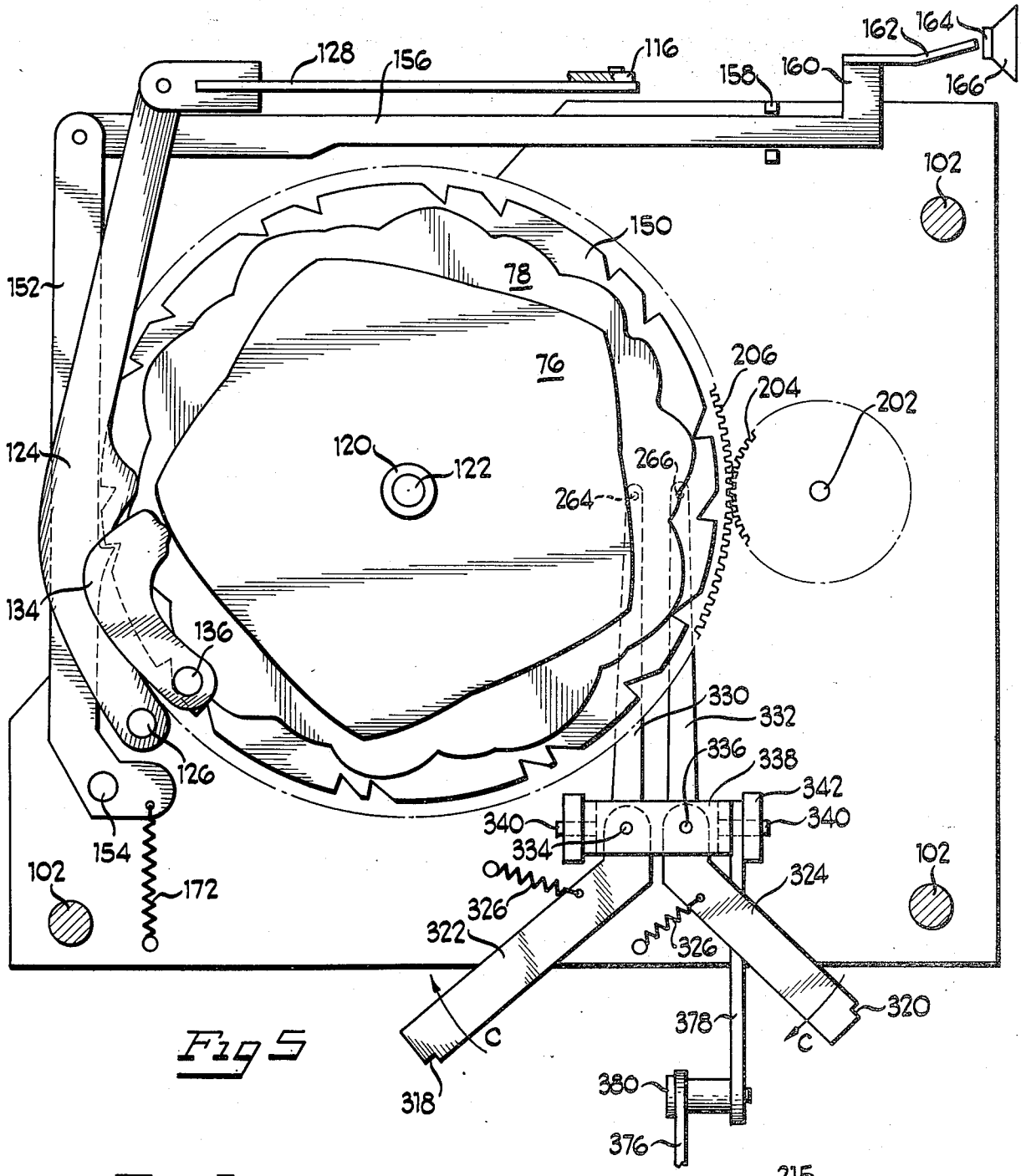
Fig 5
Fig 8
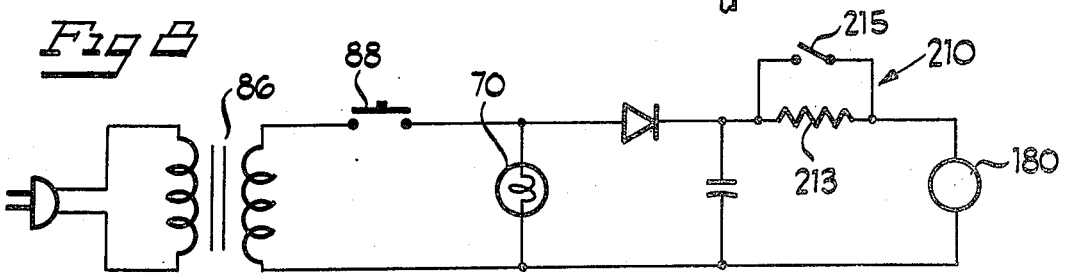

GAME APPARATUS UTILIZING A DISPLAY SCREEN

BACKGROUND OF THE INVENTION

This invention relates to an electric and mechanical apparatus wherein a game is simulated on a display screen and more particularly to an apparatus which simulates a game of the type wherein a game object appears to be hit back and forth.

In the past, some devices of this type were of a general electrical nature such as those table tennis and dart games which use a series of sequentially illuminated lightbulbs to indicate the path of travel of a ball or dart. Others were generally of an electronic nature such as those using a phosphorous coated TV-type tube and an electric beam to illuminate an area on the playing surface simulating a ball which could move back and forth between opposing players. The first of these types was limited in use in that they were expensive to produce and the intermittent, jumpy movement of the playing piece was sometimes objectionable as being unrealistic. The second of these types, although fairly accurately representing the game which they were intended to represent, were limited almost exclusively for commerical use because of their very high cost in manufacture. This invention is directed to providing a game of the character described which is readily adaptable for home use and amusement.

SUMMARY OF THE INVENTION

There are various games of the type wherein two or more players hit a game object back and forth. In the illustrative embodiment of the invention, the apparatus is shown for simulating a table tennis game. Other known games which could be simulated by a similar apparatus would include, for example, handball, volley ball, baseball and the like.

The apparatus includes a housing having a visual display screen thereon, a control means for simulating a visible path of travel of a ball on the display screen, a plurality of buttons for selectively actuating the control means and a single light source for visibly indicating the position of the ball on the display screen which is moved back and forth between opposing players on the display screen by successive reflection of a beam of light from the light source off of a plurality of coordinated mirrors which are movable by a series of interconnected cam surfaces.

BRIEF DESCRIPTION OF THE DRAWINGS

FIG. 5 is a horizontal section taken generally along the line 5—5 of FIG. 2, showing a top plan view of the control means of the present invention;

FIG. 8 is a somewhat schematic representation of the electrical circuitry and components of the present invention.

DESCRIPTION OF THE PREFERRED EMBODIMENT

Figure 1:
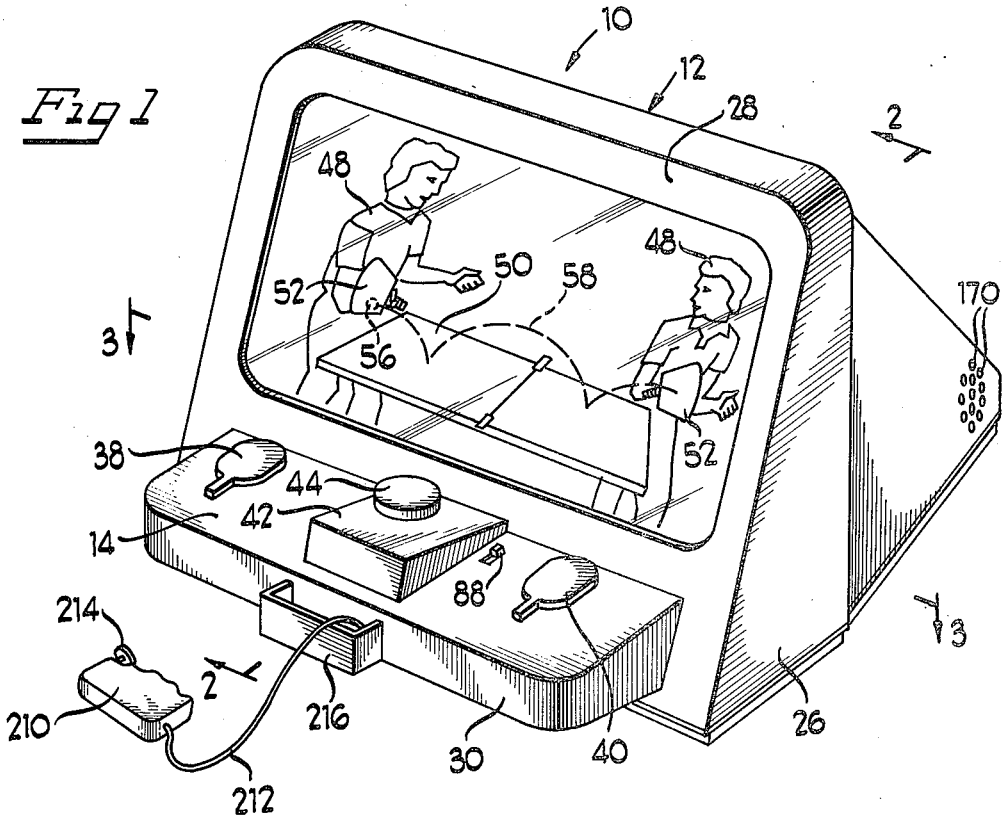
FIG. 1 is a perspective view of the game apparatus of the present invention.

Looking to FIG. 1, the amusement device according to this invention, generally designated 10, includes a housing, generally designated 12, a push-button panel 14 and a display screen 16. As shown in FIGS. 2, 3, 5 and 7, the device also includes a control means, generally designated 18, an actuating means, generally designated 20 and a serving mechanism generally designated 22.

Referring to FIG. 1, the housing 12 comprises side walls 26, a front wall 28 and an apron wall 30 which supports the push-button panel 14. The housing 12 also includes an inclined rear wall 32 (FIG. 2) and a base plate 34. The base plate 34 includes a flange 36 therearound which supports the housing on a table top or the like. The push-button panel 14 supports a lefthand actuating button 38 and a righthand actuating button 40. The actuating buttons 38 and 40 are formed in the shape of small paddles. In the center of the push-button panel 14 is a raised surface 42 which supports a serve button 44.

Figure 2:
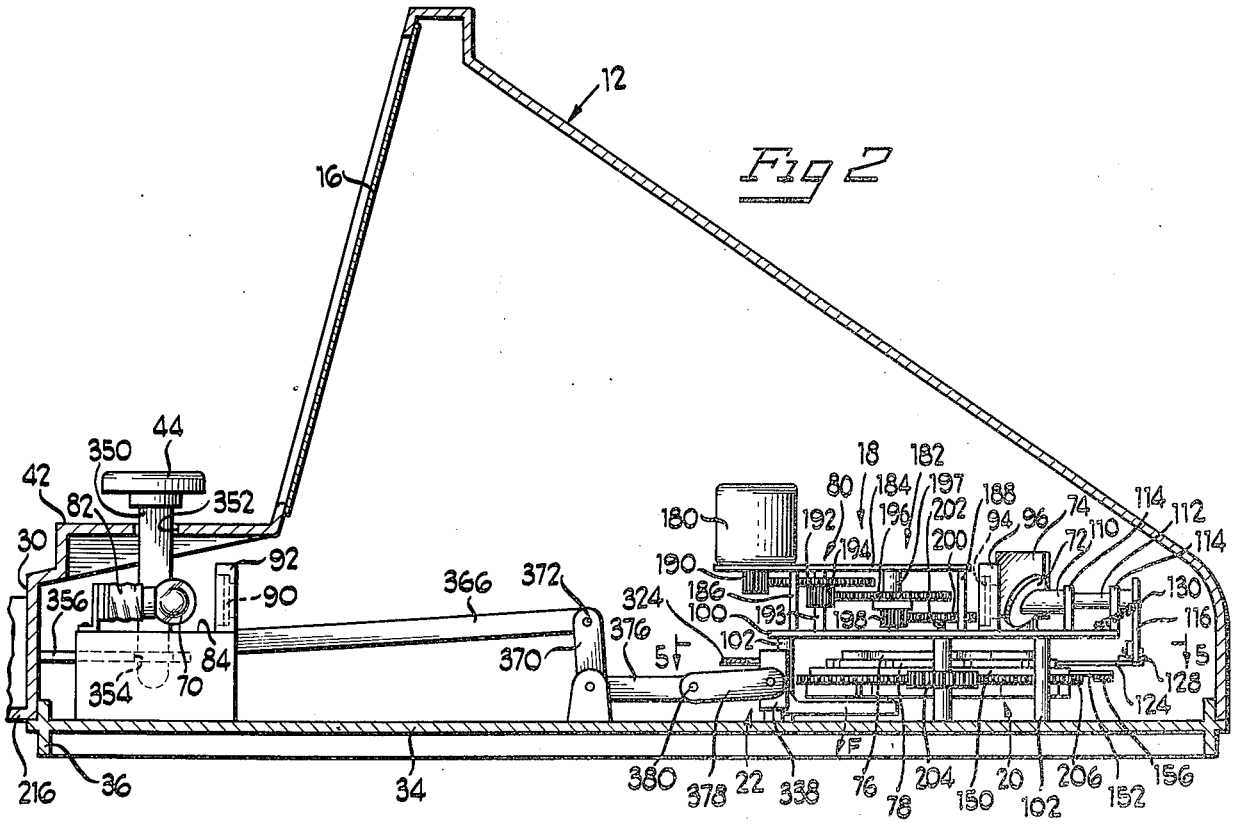
FIG. 2 is a vertical section taken generally along the line 2—2 of FIG. 1.

The display screen 16 is mounted on the housing 12 in an approximately vertical orientation, slightly inclined to the rear, as best seen in FIGS. 1 and 2. The display screen 16 is a substantially translucent sheet of glass, plastic or other suitable material, which is designated by indicia according to the game being simulated. FIG. 1 shows a display screen for a table tennis game and therefore a pair of FIGS. 48 are shown at opposite ends of a table 50. The figures each are depicted as holding a simulated table tennis paddle 52. The translucent properties of the display screen 16 allow a beam of light passing through the screen 16 to appear as a dot 56 on the display screen which simulates a table tennis ball passing back and forth between the two characters 48, along a predetermined but varying path 58.

The operative components of the device will be broken down into three major subdivisions: (1) the control means 18 for creating the simulated path of travel of the ball 56; (2) the actuating means 20 for operating the control means 18 and detecting whether the simulated table tennis ball 56 has been successfully returned or missed; and (3) the serving mechanism 22 for initiating play of the game.

CONTROL MEANS FOR CREATING THE SIMULATED PATH OF TRAVEL OF THE BALL

The control means 18 is provided to simulate the path of travel 58 of the ball 56 back and forth between the figures 48 and the paddles 52 on the display screen 16.

For ease in understanding of the description, a short explanation of the principles involved is in order. A single light source is used to create a beam of light which is focused by a series of lenses successively onto a pair of pivotally mounted mirrors. The mirrors are caused to pivot about their respective axes in a manner predetermined by a plurality of cam surfaces of the control mechanism 18. The reflected light beam will sweep back and forth across the display screen 16 which gives the visible dot 56 the appearance of a ball bouncing across the table tennis table 50 back and forth from one player to the other if kept in play.

The control means 18 generally includes a light source 70 (see FIGS. 2 and 3), a "vertical mirror" 72, a "horizontal mirror" 74, a "horizontal" cam 76 (FIG. 5) and a "vertical" cam 78. The control means 18 also includes drive means, generally designated 80 (FIG. 2), for effecting rotation of the cams 76 and 78. Mirror 72 and cam 78 are designated as the "vertical" mirror and cam since they control the vertical element of the reflected light beam on the display screen 16. Mirror 74 and cam 76 are designated as the "horizontal" mirror and cam since they control the horizontal element of the reflected light beam on the display screen.

More particularly, looking to FIG. 2, the light source 70 is a miniature lightbulb secured in a socket 82 which is mounted on a raised platform 84 near the front center of the housing. A transformer 86 (FIG. 3) provides power to the lightbulb through an on-off switch 88 (FIGS. 1 and 3) near the center of the display panel apron 14. Light rays from the lightbulb 70 passes through a first focusing lens 90 mounted in a frame 92 on the platform 84. The light beam is focused again by a lens 94 mounted in a frame 96. Frame 96 is mounted on a horizontal platform 100 which is supported on three upwardly protruding studs 102 (FIG. 5) attached to the base 34 of the housing 12. The light beam is then directed onto the vertical mirror 72 and reflected off of the vertical mirror towards the horizontal mirror 74. The horizontal mirror 74 finally reflects the light beam onto the display panel 16.

The vertical mirror 72 is circular in shape and mounted on a base 110. The base 110 is secured to a rotatable shaft 112 which is mounted on the horizontal plate 100 through two upstanding flanges 114. A portion of the shaft 112 extends through the rear flanges 114 and is secured to a crank arm 116 for rotation on the shaft 112. The crank arm 116 is associated with the vertical cam 78 to pivot mirror 72 and cause the light beam to sweep the display screen 16 in a vertical plane. More particularly, the vertical cam 78 is secured to a sleeve 120 (FIG. 5) which slides over a stud 122 secured to the base 34. Looking to FIG. 3, a cam follower arm 124 is seen in contact with the vertical cam 78. The cam follower arm 124 is pivotally mounted below the horizontal plate 100 by pin 126. The other end of the cam follower arm 124 is pivotally connected to a connecting arm 128. The connecting arm 128 is finally pivotally connected to the crank arm 116. A spring 130, attached to the crank arm 116 and the horizontal plate 100, keeps the cam follower arm 124 in constant contact with the vertical cam 78. Thus, as the vertical cam 78 rotates, the motion of the cam follower arm 124 is transmitted to the mirror 72 through the connecting arm 128 and the crank arm 116. The vertical mirror 72 is mounted on the shaft 112 at approximately a 45° angle with the axis of the shaft 112, such that rotation of the shaft 112 will cause the light beam to be reflected in varying vertical directions toward the horizontal mirror 74.

A similarly designed mechanism is provided to control the pivotal movement of the horizontal mirror 74. The horizontal mirror 74 is generally rectangular in shape and pivotally mounted on the horizontal plate 100. The horizontal cam 76 is secured to the sleeve 120 in a position above the vertical cam 78. A cam follower 134 is in constant contact with the horizontal cam 76 and pivotally mounted below the horizontal plate 100 by a pin 136. The pin 136 extends upwardly through the horizontal plate 100 and is secured to a lever 138. The lever 138 is pivotally connected to a second lever 140. The lever 140 is pivotally connected to a crank arm 142 secured to the pivotal support of the mirror 74. A spring 144, connected to the crank arm 142 and the horizontal plate 100, keeps the cam follower 134 in constant contact with the horizontal cam 76. Thus, as the cam 76 is caused to rotate, the mirror 74 will pivot back and forth as the cam follower 134 follows the periphery of the cam 76. Thus, the horizontal mirror 74, which receives a light beam from the vertical mirror 72 of varying vertical directions, will add to the light beam horizontal components and cause the ball 56 to appear on the screen to move from left to right as it moves up and down in a programmed manner.

Figure 3:
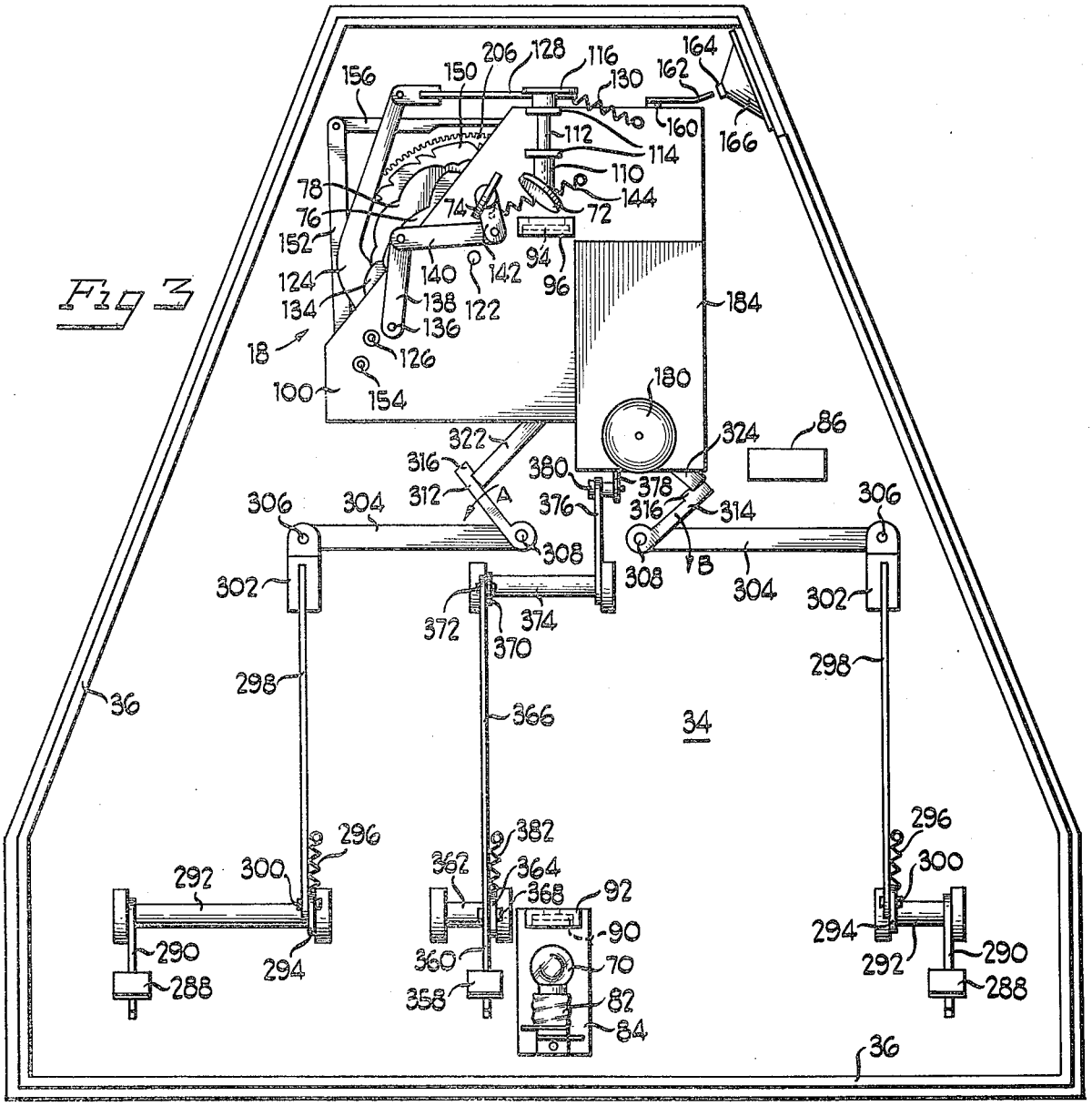
FIG. 3 is a horizontal section taken generally along the line 3—3 of FIG. 1.

To provide for a more realistic game, the device 10 also includes means for making a bouncing sound as the ball 56 bounces on the table 50 and from the paddles 52. More particularly, a sound cam 150 (FIGS. 2, 3 and 5) is secured to the sleeve 120 below the vertical cam 78 such that it is conjointly rotatable with the cams 76 and 78. A cam follower arm 152 (FIGS. 3 and 5) is in constant contact with the sound cam 150. The cam follower arm 152 is pivotally mounted on the horizontal plate 100 by means of a pin 154. The opposite end of the cam follower arm 152 is connected to a slide arm 156 (FIGS. 3 and 5). The slide arm 156 is supported by an ear 158 and includes a 90° extension 160 thereon as shown in the right of FIG. 5. The extension 160 supports a tapper 162 which strikes the base 164 of a flexible diaphragm 166 in programmed timing with the control cams 76 and 78 each time the ball 56 appears to bounce from the surface of the table 50 or the paddles 52. The audible signal escapes through a plurality of holes 170 (FIG. 1) in the side wall 26 of the housing. The cam follower 152 is kept in constant contact with the cam 150 by a spring 172 connected to the cam follower 152 and the base plate 34.

To add additional excitement and competition to the game, the horizontal cam 76 and the vertical cam 78 are non-symetrical about their peripheries to provide a plurality of different paths of travel and speed for the simulated ball 56. More particularly, the cams 76 and 78 comprise a plurality of angular segments. Each segment corresponds to the movement of the dot 56 from one paddle 52 to the other. The segments on the vertical cam 78 vary in angular size or shape so as to cause the dot 56 to bounce relatively higher and lower during contact of the cam follower 124 with different segments of the cam 78. The segments of the horizontal cam 76 also vary in angular size to cause the dot 56 to move relatively faster or slower during contact of the cam follower 134 with different segments of the cam 76. The angular size of corresponding or superimposed segments of both cams 76 and 78 are necessarily indentical to cause the vertical and horizontal elements of the light beam to simultaneously approach the paddle 52 at the limits of the path of travel 58.

The drive means 80 is provided for effecting conjoint rotation of the cams 76, 78 and 150 and generally includes a motor 180 and a gear train 182. More particularly, an additional horizontal plate 184 (FIGS. 2 and 3) is secured to two studs 186 and 188 on the horizontal plate 100. The variable speed electric motor 180 is mounted on the horizontal plate 184 and is provided with a pinion gear 190 which extends below the horizontal plate 184. The pinion gear 190 is in engagement with a gear 192 which is mounted on a rotatable shaft 193 and includes an integrally formed pinion gear 194. The pinion gear 194 is in meshing engagement with a similar gear 196 which is mounted on a rotatable shaft 197 and is formed integrally with a pinion gear 198. The pinion gear 198 is in meshing engagement with a gear 200 mounted on a shaft 202 which extends below the horizontal plate 100. The shaft 202 is provided with an increased diameter below plate 100 to give it additional support. A gear 204 is mounted on the shaft 202 in engagement with a large gear 206. The large gear 206 is secured to the sleeve 120 below the sound cam 150 to give rotation to the cams 76, 78 and 150. The motor 180 also is powered through the transformer 86 (FIG. 1). A hand held speed control device 210 is connected in series with the transformer 86 and the motor 180 by a wire 212. The speed control device 210 permits a player of the game to remove a resistor 213 (FIG. 8) from the motor circuit by depressing a button 214 thereon. As can be seen in FIG. 8, the speed control device includes a switch 215 connected in parallel with the resistor 213 in the motor circuit so that the resistor will be removed from the circuit when the button 214 is depressed and the switch 215 is closed. This allows the motor to run faster while the button 214 is depressed. A receptical 216 is provided on the front of the apron wall 30 to hold the speed control device 210 when it is not in use. A slip clutch also is provided between the gear 204 and the shaft 202 to allow for slippage, without damage to the motor 180, when the large gear is stopped by the actuating means, to be described in greater detail hereinafter.

ACTUATING MEANS FOR OPERATING THE CONTROL MEANS AND DETECTING WHETHER THE BALL HAS BEEN SUCCESSFULLY RETURNED OR MISSED

Figure 6:
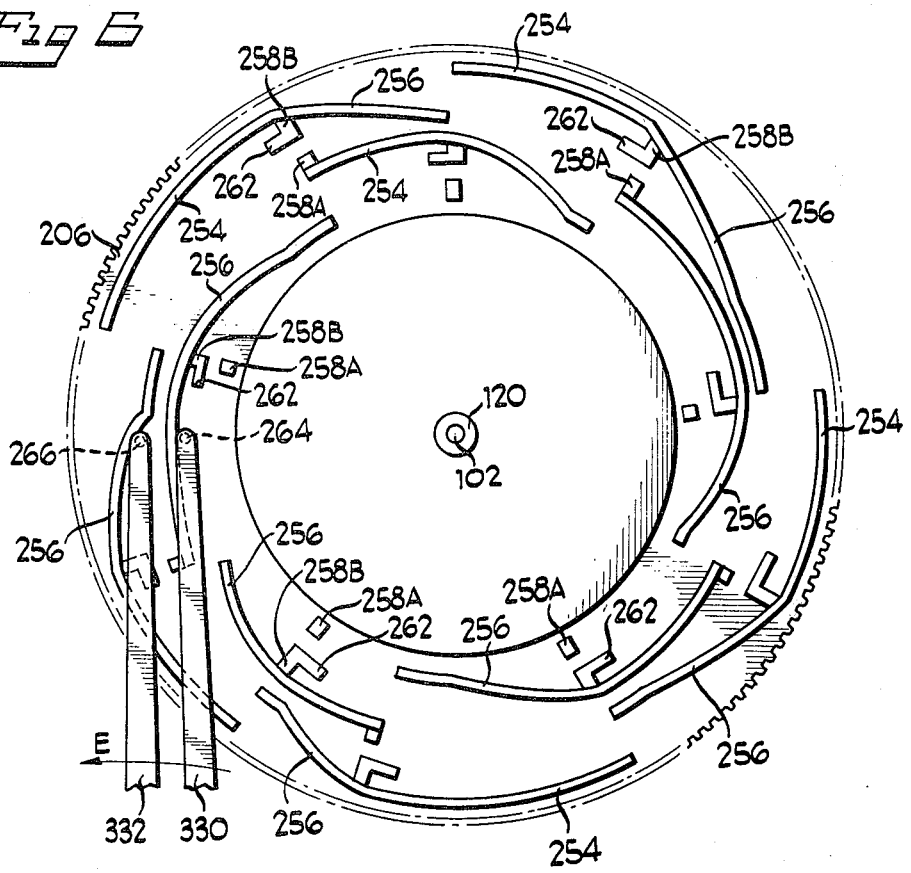
FIG. 6 is a bottom plan view of the actuating means and part of the control means of the present invention.

The game device 10 is provided with an actuating means 20 (FIGS. 2 and 6) to operate the control means 18 and keep the ball 56 in play (i.e., moving) if the actuating buttons 38 and 40 are depressed during a predetermined interval of time as the ball 56 approaches the paddles 52. The actuating means also is a miss detecting device for detecting whether a ball 56 has been successfully returned to the opponent as in the game being simulated. The actuating means 20 generally includes the actuating buttons 38 and 40, and their connecting linkages, and a plurality of guide surfaces 254, a plurality of reset surfaces 256, a plurality of stop surfaces **258*a* and 258*b*, and a plurality of leading edge ribs 262 mounted on the lower side of the gear 206, as best seen in FIG. 6. A complete set (equal to the number of volleys per revolution of the cams) of guide surfaces 254, reset surfaces 256, stop surfaces 258*a* and 258*b*, and leading edge ribs 262 are provided for each of the actuating buttons 38 and 40 concentrically on the gear 206. The guide surfaces 254, reset surfaces 256, stop surfaces 258*a* and 258*b* and leading edge ribs 262 which are operatively associated with the lefthand actuating button 38 are disposed concentrically inward of those associated with the righthand button 40.**

A pair of movable contact pins 264 and 266 are associated with the actuating buttons 38 and 40, respectively. The operation of the contact pins 264 and 266 in conjunction with stop surfaces **258*a* and 258*b*, the guide surfaces 254, the reset surfaces 256 and the leading edge ribs 262 will be described after the linkage associated with the actuating buttons 38 and 40** is set forth.

Figure 4:
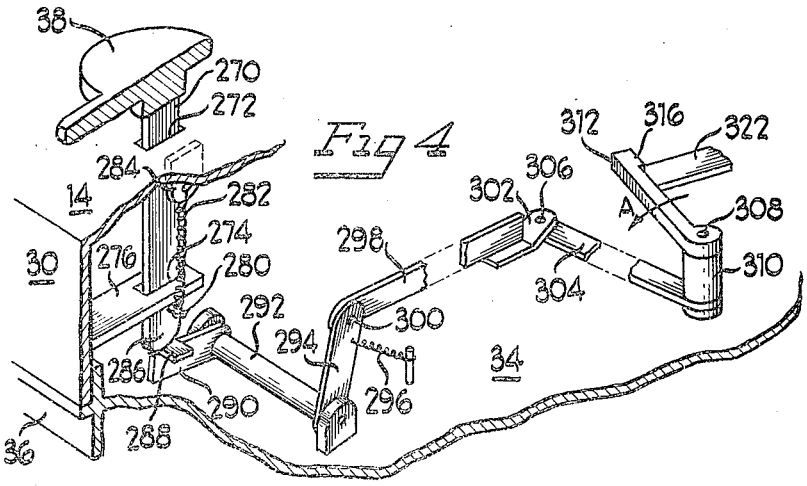
FIG. 4 is a partially broken away perspective view, on an enlarged scale, of an actuating button and connecting linkage.

Each actuating button 38 and 40 is associated with its respective contact pin 264 and 266 by similar linkages therefore both will be described and designated by similar numbers with reference to the actuating button 38 (FIG. 4).

The actuating button 38 is mounted on a slidable shaft 270. The shaft is supported by a slot 272 in the pushbutton panel 14 and another slot 274 provided in a tab 276 mounted on the apron wall 30 of the housing 12. The shaft 270 is provided with a pin 280 which is connected by a spring 282 to an ear 284 depending from the push-button panel 14 to bias the button 38 toward its uppermost position. The pin 280 also serves to limit the upward travel of the button 38 as it contacts the tab 276. The lower end of the shaft 270 is provided with a cam surface 286 in contact with a tab 288 on a crank arm 290. The crank arm 290 is secured to a shaft 292 which is pivotally mounted on the base plate 34 of the housing. Another crank arm 294 is provided on the opposite end of the shaft 292. The shaft 292 is biased in a clockwise direction, as seen in FIG. 4, by a spring 296 connecting the crank arm 294 to the base plate 34. An extended control arm 298 is pivotally connected to the crank arm 294 by a pin 300. A flanged tab 302 is provided on the opposite end of the control arm 298 and is connected to another crank arm 304 by a pin 306. The crank arm 304 is pivotally mounted on a pin 308 which is secured to the base plate 34. A journal 310 connects the crank arm 304 with another crank arm 312 such that when a button 38 is depressed the described linkage causes the crank arm 312 to rotate in the direction of arrow A (FIGS. 3 and 4).

Similarly designated elements are connected to actuating button 40, as seen in FIG. 3, which causes a complementary crank arm 314 to rotate in the direction of arrow B (FIG. 3).

Each crank arm 312 and 314 is provided with a raised or notched portion 316. The notched portions 316 engage with mating notched portions 318 and 320 (FIG. 5) on connecting links 322 and 324, respectively. The connecting links 322 and 324 are each biased by a spring 326 connected to the base plate 34. Thus, upon depressing one of the buttons 38 or 40, the associated crank arm 312 or 314 will rotate as indicated by arrow A or B and will permit the connecting links 322 or 324 to rotate in a clockwise direction as shown by arrow C in FIG. 5, under the force of the biasing springs 326.

Figure 7:
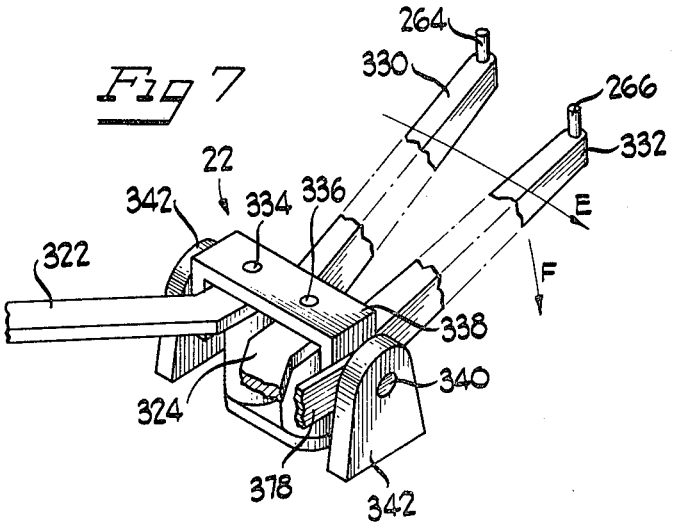
FIG. 7 is a perspective view of the serving mechanism of the present invention.

The connecting links 322 and 324 are finally connected to a pair of control arms 330 and 322, respectively. The control arms 330 and 332 support the contact pins 264 and 266 as best seen in FIGS. 5 and 7. The control arms 330 and 332 are pivotally supported by means of pins 334 and 336 in a generally rectangular frame 338. The rectangular frame 338 also is pivotally supported by means pf pins 340 in ears 342 on the base plate 34 for relative vertical movement of the contact pins 264 and 266 as required for the serving mechanism, to be described in greater detail hereinafter.

Therefore, when the buttons 38 and 40 are depressed the control arms 330 and 332, rotate in the direction of arrow E as shown in FIGS. 6 and 7 under the force of the springs 326.

An explanation of the miss detecting component of the actuating means will aid in the description. The control means 18, as previously described, simulates a ball bouncing back and forth between the simulated players 48 on the display screen. The actuating buttons 38 and 40 are used by the players of the game to cause an approaching ball 56 to appear to bounce off a particular paddle 52 and return to the opposing player. The ball 56 will continue to pass back and forth between the players unless the gear 206 of the control means 18 is prevented from rotating. A slip clutch in the gear train 182 allows the gear 206 to stop without damaging the motor 180 or other components.

For this result the contact pins 264 and 266 on the control arms 330 and 332 are utilized to stop the gear 206 and thus indicate that a ball 56 has been missed as described below. As the ball 56 is approaching a particular player, the actuating buttons 38 or 40 can be operated generally in one of three manners: (1) it can be activated too early, which causes the gear 206 to stop; (2) it can be operated too late, which also causes the gear 206 to stop; or (3) it can be actuated timely which causes the gear 206 to continue to rotate and thus the ball 56 to continue to be volleyed. The operation of the actuating buttons 38 and 40 along with the miss detecting mechanism will therefore be described in that order.

As previously mentioned, actuation of either button 38 or 40 causes the control arms 330 and 332 to rotate outwardly in the direction of arrow E. The view in FIG. 6 (which is a bottom view) shows a position when the actuating button 38, which controls the control arm 330, has been actuated too early and the control arm 330 has rotated outwardly and contacted the guide surface 254. Then, as the gear 206 continues to rotate, the contact pin 264 will be guided by the guide surface 254 and contact the stop surface 258b. This will stop the gear 206 from rotating and indicates that a player has failed to return the ball 56. On the other hand, if the player had not actuated the button 38 or actuated it too late, the contact element 264 would have abutted the stop surface **258*a* and similarly stopped the gear 206 from rotating. Thus, either too early or too late actuation of the actuating button will cause the gear 206 to stop rotating and thus cause the ball 56 to come to rest on the appropriate paddle 52** indicating that a player has failed to return the ball. In this event, a point is awarded to the opponent player as in the game of table tennis.

The third alternative is to actuate the button 38 or 40 as the ball approaches the paddle and cause the contact element 266 or 264 to pass between the stop surfaces **258*a* and 258*b* and thereby permitting the gear 206 to continue to rotate. In order to make this more feasible, a leading edge rib 262 is provided adjacent each stop surface 258*b* of sufficient length to allow approximately an interval of 6° of rotation in which the player may timely actuate his button. Thus, when actuated, the control arms 330 or 332 rotate in the direction of arrow E and the contact elements 264 or 266 on the end of the control arms will contact the leading edge rib 262 and be guided through the space between the stop surfaces 258*a* and 258*b*. Of course, it is the object of the game to timely actuate the actuating button 38 or 40 so as to permit the ball 56** to return to the opposing player.

The control arms 330 and 332 are biased in the direction of arrow E after the contact element 264 and 266 passes between the stop surfaces **258*a* and 258*b*. Therefore, a reset surface 256 is provided to rotate the control arms 330 and 332 back to their original position. As the control arms 330 and 332 resume their original position the connecting linkages 322 and 324 will be reset and catch on the notches 316 of the crank arms 312 and 314. Therefore, the control arms 330 and 332 will remain in that position until the buttons 38 or 40 again are actuated. At this time, it should be pointed out that the number of stop surfaces 258*a* and 258*b* along with the number of guide surfaces 254, reset surfaces 256 and leading edge ribs 262 is determined by the number of volleys provided for on the horizontal cam 76 for each revolution of the cam 76. The device will continue to operate and the ball will continue to move back and forth until one of the contact pins 264 or 266** abuts a stop surface.

SERVING MECHANISM

The serving mechanism, generally designated 22, is provided to initiate a volley at the beginning of a game or after one of the players has failed to return the ball by allowing his contact pin 264 or 266 to abut one of the stop surfaces **258*a* or 258*b*. More particularly, the serving mechanism 22 comprises the serving button 44 (FIG. 2) on the raised portion 42 of the push button panel 14. The operation of the serve button is similar to that of the actuating buttons 38 and 40. The serve button 44 is mounted on a slidable plunger 350 which is supported in a slot 352 in the top of the raised surface 42 and a second slot 354 provided for in a tab 356 (FIG. 2) attached to the apron wall 30 of the push button panel 14. The lower end of the plunger 350 contacts a tab 358 located on a crank arm 360 (FIG. 3). The crank arm 360 is mounted on a pivotally supported shaft 362. Another crank arm 364 is mounted on the shaft 362 and is pivotally connected to an extended connecting arm 366 by means of a pin 368. The opposite end of the connecting arm 366 is pivotally connected to another crank arm 370 by means of a pin 372. The crank arm 370 is mounted on a shaft 374 which is pivotally mounted on the base plate 34. The shaft 374 has a second crank 376 secured thereon and pivotally connected to a final link 378 by means of a pin 380. The link 378 is secured to the pivotally mounted rectangular control arm support 338. The serve button 44 is biased in an upward direction by means of a spring 382 connected to the crank arm 364 and the base plate 34. Actuation of the serving button 44 will therefore cause the control arms 330 and 332 to rotate downwardly in the direction of arrow F, as shown in FIGS. 7 and 2. An integral part of the serving mechanism 22 is the dimensions of the stop surfaces 258a and 258b and guide surfaces 254 on the gear 206. The stop surfaces 258*a* and 258*b* are approximately 1/16 of an inch lower than the surface of the gear 206. The guide surfaces 254 and the reset surfaces 256 are approximately ⅛ of an inch lower than the surface of the gear 206**.

The serving mechanism provides that the pins 264 and 266 on the control arms 330 and 332 will move downwardly in the direction of arrow F (FIG. 7) approximately 1/16 of an inch when the serve button is depressed in order to clear the stop surfaces **258*a* and 258*b*. However, the contact elements 264 and 266 cannot move downwardly far enough to clear the guide surfaces 254 and the reset surfaces 256 and therefore they will always be kept in proper orientation. Thus, to initiate a new volley after a contact element 264 or 266 has abutted a stop surface 258*a* or 258*b*, a player merely depresses the serve button 44 allowing the contact pins 264 and 266 to pass under the stop surfaces 258***a* or 258*b*, allowing the gear 206 to continue to rotate, This rotation causes the ball 56 again to traverse a path across the display screen 16 for the resumption of play. It may be noted that as described above, the player who has just missed returning a ball to the opposing player would always necessarily serve the next ball thus being an unrealistic representation of the actual game of table tennis, since the rules of table tennis require a player to serve five consecutive balls before the other has an opportunity to serve. In order to be more realistic, however, the players may wish to return the ball to a particular server under the rules of table tennis. To achieve this more realistic game rule, the players need only depress the serve button one time and allow the ball to return to the player who should be serving, where it will stop since neither of the actuating buttons has been depressed, and then permit that player to initiate the next volley.

The foregoing detailed description has been given for clearness of understanding only and no unnecessary limitations should be understood therefrom, as some modifications will be obvious to those skilled in the art.

We claim:

1. In a game device including a housing having a display screen, two stationary reference means defined thereon for representing opposing players of the game and control means for producing a visible path of travel of an object on said screen, the improvement in said control means comprising:

a single light source mounted within the housing for producing a beam of light in the visible spectrum;

light directing means associated with said light source for variably directing said beam of light onto the display screen wherein the light image which appears on the screen from said beam defines said object, said light directing means including drive means for moving said light directing means so that said object appears to move on said screen;

selectively operable actuating means associated with each of said reference means and operated by opposing players of the game for representatively simulating an attempted hitting of the object by one of the reference means as the object approaches the respective reference means on the screen; and a hit and miss detector associated with said light directing means and said actuating means for sensing when said object has been "hit" or "missed" by said reference means, said hit and miss detector assuming a miss mode when it senses a miss and a hit mode when it senses a hit, said hit and miss detector stopping the movement of said light image when in the miss mode and permitting continual movement of said light image when in the hit mode.

2. The device of claim 1 wherein said light source is stationary.

3. The device of claim 1 wherein said light directing means includes movable reflecting means for directing the beam of light onto the display screen.

4. The device of claim 3 wherein said light directing means includes programmable means connected to said movable means for moving said object on the screen in a predetermined path of travel.

5. The device of claim 1 wherein said light directing means includes programmable means for moving said light directing means so as to move said object on the screen in a predetermined path of travel.

6. In a game device including a housing having a passive, translucent display screen with two reference means for simulating reboundable surfaces thereon, for opposing players of the game, and control means for producing a visible path of travel of an object on said display screen back and forth between the reference means, the improvement in said control means comprising:

a single, stationary light source mounted within the housing for producing a beam of light in the visible spectrum;

light directing means associated with said light source for variably directing said beam of light onto the display screen wherein the light image which appears on the screen from said beam defines said object, said light directing means including programmable means for variably directing said beam of light in a predetermined pattern and drive means associated therewith for moving said programmable means to cause the light image which appears on the screen to move in a predetermined path of travel on the display screen back and forth between said reference means; and selectively operable actuating means associated with each of said reference means and operated by opposing players of the game for representatively simulating an attempted hitting of the object by one of the reference means as the object approaches the respective reference means on the display screen.

7. In a table tennis game device including a housing having a display screen thereon and control means for producing a visible path of travel of an object on said screen, an improvement comprising:

a single light source mounted within the housing for producing a beam of light in the visible spectrum;

light directing means associated with said light source for variably directing said beam of light onto the display screen wherein the light image which appears on the screen from said beam defines said object, said light directing means including drive means for moving said light directing means so that said object appears to move on said screen;

a pair of player response reference means defined on said display screen for viewing by the opposing players of the game for simulating reboundable implements for hitting of the object, and selectively operable actuating means associated with each reference means for representatively simulating an attempted contacting and rebounding of the object by and away from the reference means; and a hit and miss detector associated with said player responsive reference means for sensing and indicating whether or not said object has been representatively "hit" by the reference means.

8. The game device of claim 7 wherein the display screen includes a simulated table tennis playing surface and the two reference means are simulated table tennis paddles for opposing players of the game.

9. In a game device including a housing having a display screen with two references thereon representing opposing players of the game, and control means for producing a visible path of travel of an object on said display screen back and forth between the references, the improvement in said control means comprising:

a single, stationary light source mounted within the housing for producing a visible beam of light;

light directing means associated with said light source for variably directing said beam of light onto the display screen wherein the light image which appears on the screen from said beam defines said object, said light directing means including a movable horizontal component director moving said beam of light in a horizontal direction and a complementary movable vertical component director for moving said beam of light in a vertical direction, programmable means associated with the vertical and horizontal directors for moving said directors simultaneously in a predetermined pattern, and drive means associated with the programmable means for moving said programmable means to cause the light image which appears on the screen to move in a predetermined path of travel on the display screen;

a hit and miss detector associated with said light directors for sensing when said object has "hit" or "missed" a reference, said hit and miss detector assuming a miss mode when it senses a "miss" and a hit mode when it senses a "hit", said hit and miss detector including means defining a path of travel having a stop surface and a follower engageable with said stop surface, means for stopping the movement of the light directors in response to said follower engaging said stop surface for permitting continued movement of said light directors when the follower is not in engagement with the stop surface; and selectively operable actuating means including hitting means operably connected to said follower for moving said follower in an attempt to avoid engagement of said follower with said stop surface so as to keep said hit and miss detector in a hit mode, and means providing for only a given period of time for operating said actuating means.

10. In a simulated table tennis game device including a housing having a display screen with a simulated table and two paddles thereon for opposing players of the game, and control means for producing a visible path of travel of a simulated table tennis ball on said display screen back and forth between the paddles, the improvement in said control means comprising:

a single, stationary light source mounted within the housing for producing a visible beam of light;

light directing means associated with said light source for variably directing said beam of light onto the display screen wherein the light image which appears on the screen from said beam defines the ball, said light directing means including a movable horizontal component mirror for reflecting said beam of light so that the ball appears to move in a horizontal direction and a movable vertical component mirror for reflecting said beam of light so that the ball appears to move in a vertical direction, a cam associated with each movable mirror and including a cam follower operatively connecting each mirror with one of said cams to move said mirror in a predetermined manner so as to reflect said beam of light sequentially from one mirror onto the other mirror and finally onto the display screen, and drive means associated with the cams for rotating said cams to cause the ball which appears on the screen to move in a predetermined path of travel, back and forth, between the paddles;

a hit and miss detector associated with said mirrors for sensing when said ball has "hit" or "missed" a paddle, said hit and miss detector assuming a miss mode when it senses a "miss" and a hit mode when it senses a "hit", said hit and miss detector including a plurality of sets of cam surfaces and a cam follower engageable with said cam surfaces, each said set of cam surfaces including a reset surface operably associated with said cam follower for moving the cam follower to its starting position, stop surface means comprising a first portion and a second portion with a space therebetween defining a hit passageway through which the cam follower passes as the hit and miss detector senses a "hit", the stop surface means, on engagement with the cam follower stopping the movement of the mirrors; and selectively operable actuating means including hitting means operatively connected to said cam follower for moving said cam follower from its normal position through said space so as to avoid engagement of said cam follower with said stop surface means and to keep said hit and miss detector in a hit mode.

11. The device of claim 10 including serving means operatively connected to said cam follower for moving said cam follower out of engagement with said stop surface so as to change said hit and miss detector from its miss mode to its hit mode and wherein the follower arm is pivotally mounted within the housing to permit rotation in a vertical plane to move said cam follower out of engagement with the stop surface means upon actuation of the serve means so as to change said hit and miss detector from its miss mode to its hit mode.

12. The device of claim 10 wherein the control means includes a third cam operatively associated with said drive means for producing an audible signal as the ball appears to rebound from the paddles and the surface of the table.

13. The device of claim 10 wherein the hit and miss detector includes two cam followers, one for each player of the game, and two series of sets of cam surfaces, one for each cam follower.

14. In a simulated table tennis game device including a housing having a display screen with a simulated table and two paddles thereon for opposing players of the game, and control means for producing a visible path of travel of a simulated ball on said display screen back and forth between the paddles, the improvement in said control means comprising:

a single, stationary light source mounted within the housing for producing a visible beam of light;

light directing means associated with said light source for variably directing said beam of light onto the display screen wherein the light image which appears on the screen from said beam defines the ball, said light directing means including a movable horizontal component mirror for reflecting said beam of light so that the ball appears to move in a horizontal direction and a movable vertical component mirror for reflecting said beam of light so that the ball appears to move in a vertical direction, a cam associated with each movable mirror and including a cam follower operatively connecting each mirror with one of said cams to move said mirror in a predetermined manner so as to reflect said beam of light sequentially from one mirror onto the other mirror and finally onto the display screen, and drive means associated with the cams for rotating said cams to cause the ball which appears on the screen to move in a predetermined path of travel, back and forth, between the paddles; and a hit and miss detector associated with said mirrors for sensing when said ball has "hit" or "missed" a paddle, said hit and miss detector assuming a miss mode when it senses a "miss" and a hit mode when it senses a "hit".

15. In a game device including a housing having a display screen with two references thereon representing opposing players of the game, and control means for producing a visible path of travel of an object on said display screen back and forth between the references, the improvement in said control means comprising:

a single, stationary light source mounted within the housing for producing a visible beam of light;

light directing means associated with said light source for variably directing said beam of light onto the display screen wherein the light image which appears on the screen from said beam defines said object, said light directing means including a movable horizontal component mirror for moving said beam of light in a horizontal direction and a complementary movable vertical component mirror for moving said beam of light in a vertical direction, programmable means associated with the vertical and horizontal directing mirrors for moving said mirrors simultaneously in a predetermined pattern, and drive means associated with the programmable means for moving said programmable means to cause the light image which appears on the screen to move in a predetermined path of travel on the display screen wherein the programmable means includes two undulated cam surfaces and includes a cam follower operatively connecting each mirror with one of said cam surfaces to move the mirror in a predetermined manner so as to cause the object on the display screen to appear to move in a predetermined path of travel back and forth between the references.

16. The device of claim 15 wherein the cam surfaces include a plurality of sets of cam surfaces so as to move the object back and forth between the references a predetermined number of times in varying paths of travel during one revolution of the cam.

17. The device of claim 15 wherein the programmable means includes a third undulated cam surface which causes an audible signal to be produced as the object appears to rebound from the references.

18. A simulated table tennis game device including a housing having a display screen with a simulated playing surface and two reference means at opposite ends thereof for representing opposing players of the game and a control means for producing a visible path of travel of a simulated ball on the screen, comprising:

a single light source mounted within the housing for producing a beam of light in the visible spectrum;

light directing means associated with said light source for variably directing said beam of light onto the display screen wherein the light image which appears on the screen from said beam defines said ball, said light directing means including drive means for moving said light directing means so that the ball appears to move on said screen back and forth between the respective reference means;

selectively operable actuating means associated with each of said reference means and operated by the opposing players of the game for representatively simulating an attempted hitting of the ball by one of the reference means as the ball approaches the respective reference means on the screen; and a hit and miss detector associated with the light directing means and said selectively operable actuating means for sensing when said object has been "hit" or "missed" by said reference means, said hit and miss detector stopping the movement of said ball to represent a miss and premitting continued movement of said ball when indicating a hit.

19. In a game device including a housing having a display screen having at least one reference thereon and control means for producing a visible path of travel of an object on said screen, the improvement in said control means comprising:

a single light source mounted within the housing for producing a visible beam of light;

light directing means associated with said light source for variably directing said beam of light onto the display screen wherein the light image which appears on the screen from said beam defines said object, said light directing means including drive means for moving said light directing means so that said object appears to move on said screen;

selectively operable actuating means for representatively simulating an attempted hitting of the object by the reference; and a hit and miss detector associated with said light directing means and said actuating means for sensing when said object has been "hit" or "missed" by said reference, said hit and miss detector assuming a miss mode when it senses a miss and a hit mode when it senses a hit, said hit and miss detector stopping the movement of said light image when in one mode and allowing the movement of said light image when in the other mode, wherein said hit and miss detector has means to stop the movement of said light directing means when in the miss mode and allow for continued movement of said light directing means when in the normal hit mode.

20. The device of claim 19 wherein said hit and miss detector includes cam means having at least one stop surface and at least one movable cam follower engageable with said stop surface, whereby said hit and miss detector is in the miss mode after said follower engages said stop surface.

21. The device of claim 20 wherein said actuating means includes hitting means operably connected to said follower for moving said follower so as to avoid engagement of said follower with said stop surface to keep said hit and miss detector in a hit mode, and serving means operably connected to said follower for moving said follower out of engagement with said stop surface to change said hit and miss detector from its miss mode to its hit mode.

22. In a game device including a housing having a display screen having at least one reference thereon and control means for producing a visible path of travel of an object on said screen, the improvement in said control means comprising:

a single light source mounted within the housing for producing a visible beam of light;

light directing means associated with said light source for variably directing said beam of light onto the display screen wherein the light image which appears on the screen from said beam defines said object, said light directing means including drive means for moving said light directing means so that said object appears to move on said screen, a movable horizontal component director for moving said beam of light in a horizontal direction, and a movable vertical component director for moving said beam of light in a vertical direction whereby the combined movement of said directors defines the path of travel of the light image on the screen;

selectively operable actuating means for representatively simulating an attempted hitting of the object by the reference; and a hit and miss detector associated with the light directing means and said actuating means for sensing when said object has been "hit" or "missed" by said reference, said hit and miss detector assuming a miss mode when it senses a miss and a hit mode when it senses a hit, said hit and miss detector stopping the movement of said light image when in one mode and permitting continued movement of said light image when in the other mode.

23. The device of claim 22 wherein said light directing means includes programmable means for moving said directors so that said object appears to move in a predetermined path of travel.

24. The device of claim 22 wherein each director is a movably mounted reflector, said reflectors being positioned relative to the light source, display screen and each other so that the beam of light will be sequentially reflected from one reflector to the other reflector and onto the screen.

25. In a game device including a housing having a display screen having at least one reference thereon and control means for producing a visible path of travel of an object on said screen, the improvement in said control means comprising:

a single light source mounted within the housing for producing a visible beam of light; and light directing means associated with said light source for variably directing said beam of light onto the display screen wherein the light image which appears on the screen from said beam defines said object, said light directing means including drive means for moving said light directing means so that said object appears to move on said screen, said drive means having movable means for directing the beam of light onto the display screen comprising a path follower and means for defining a Y-shaped path of travel for said path follower, including a first leg having a first stop surface defining the end of said first leg and a second leg having a second stop surface defining the end of said second leg to define a hit passageway therebetween.

26. The device of claim 25 wherein said light directing means includes means for defining a plurality of varying Y-shaped paths of travel.

* * * * *